US011280600B2

(12) United States Patent
Turner et al.

(10) Patent No.: US 11,280,600 B2
(45) Date of Patent: Mar. 22, 2022

(54) SAFETY AND ARMING UNIT FOR A MUNITION

(71) Applicant: Thales Holdings UK Plc, Reading (GB)

(72) Inventors: Laurence Turner, Reading (GB); John Morris, Belfast (IE); Patrick Mallon, Belfast (IE); Christopher Wilson, Belfast (IE); Ronald Fleming, Belfast (IE)

(73) Assignee: Thales Holdings UK Plc, Reading (GB)

( * ) Notice: Subject to any disclaimer, the term of this patent is extended or adjusted under 35 U.S.C. 154(b) by 71 days.

(21) Appl. No.: 16/525,070

(22) Filed: Jul. 29, 2019

(65) Prior Publication Data

US 2020/0033106 A1 Jan. 30, 2020

(30) Foreign Application Priority Data

Jul. 30, 2018 (GB) ..... 1812405

(51) Int. Cl.

| | |
|---|---|
| ***F42C 15/00*** | (2006.01) |
| ***F42C 11/06*** | (2006.01) |
| ***F42C 15/40*** | (2006.01) |
| ***F42C 15/196*** | (2006.01) |

(52) U.S. Cl.

CPC ..... *F42C 15/196* (2013.01); *F42C 11/06* (2013.01); *F42C 15/005* (2013.01); *F42C 15/40* (2013.01)

(58) Field of Classification Search

CPC ..... F42C 15/005; F42C 15/196; F42C 15/40; F42C 11/06

See application file for complete search history.

(56) References Cited

U.S. PATENT DOCUMENTS

| | | | | |
|---|---|---|---|---|
| 3,599,572 A * | 8/1971 | Brackman | ..... | F42C 14/06 102/221 |
| 3,866,535 A * | 2/1975 | Hedeen | ..... | F42C 15/29 102/224 |
| 5,497,704 A * | 3/1996 | Kurschner | ..... | F42C 11/06 102/264 |
| 7,240,617 B1 * | 7/2007 | Bonbrake | ..... | F42C 15/40 102/215 |

(Continued)

FOREIGN PATENT DOCUMENTS

| | | |
|---|---|---|
| EP | 2042827 | 4/2009 |
| EP | 2867609 | 11/2017 |

OTHER PUBLICATIONS

European Search Report from EP 19187661 dated Nov. 22, 2019, 8 pages.

(Continued)

*Primary Examiner* — Gabriel J. Klein

(74) *Attorney, Agent, or Firm* — Dority & Manning, P.A.

(57) ABSTRACT

A safety and arming device for a munition is operable to arm and initiate a munition dependent on determining separation from a munition platform, determining detection of free fall of the device for a first time period following separation, initiating a roll manoeuvre of the munition and determining detection of the execution of the roll manoeuvre within a second time period, and generating a munition firing signal, dependent on detection of all of separation, free fall, and the roll manoeuvre.

8 Claims, 6 Drawing Sheets

(56) References Cited

U.S. PATENT DOCUMENTS

| | | | | |
|---|---|---|---|---|
| 2008/0047451 | A1* | 2/2008 | Johnson | F42C 15/40 102/221 |
| 2010/0199873 | A1* | 8/2010 | Rastegar | F42C 11/008 102/262 |
| 2012/0240805 | A1* | 9/2012 | Kautzsch | F42C 15/24 102/215 |
| 2014/0000470 | A1* | 1/2014 | Biggs | F42C 15/40 102/215 |

OTHER PUBLICATIONS

IPO Combined Search and Examination Report for GB1812405,7, dated Jan. 30, 2019, 5 pages.

* cited by examiner

SAFETY AND ARMING UNIT FOR A MUNITION

FIELD

Embodiments disclosed herein relate to providing apparatus and methods for safe arming of a munition.

BACKGROUND

A munition arming unit provides a mechanism for sensing whether conditions exist for the arming of a munition. This arming process can include initiation of release of the munition from a platform (such as an aircraft), and further may include the generation of trigger signals to initiate detonation of the munition. Thus, an arming unit generally includes mechanisms configured to avoid inadvertent arming and release of a munition. In one paradigm, regulations may be imposed that two independent measurable parameters must be sensed with respect to predetermined thresholds, before a munition arming unit can enter the armed state. According to established standard procedures, the first of these parameters is whether or not a signal has been received indicating intent to release the munition. The second of these parameters may be related to a measure indicating that one or more conditions of the environment, in which the munition platform resides, match parameters which would normally be associated with release of the munition. Existing arrangements involve some form of environment sensing. That is, mechanisms are provided for detection of certain measureable criteria of the environment and to use these as a safeguard to ensure that actions on a munition are not misinterpreted as a trigger for arming and/or release.

However, such existing mechanisms may suffer from drawbacks. For instance, they may not be entirely independent of primary arming and release conditions, they may directly affect the performance of the associated munition, they may require specific initiation arrangements on-board the munition platform prior to release, and they may require specific arrangements on-board the munition platform to deal with possible icing, which could affect arming and release.

FIGURES

Figure 3:
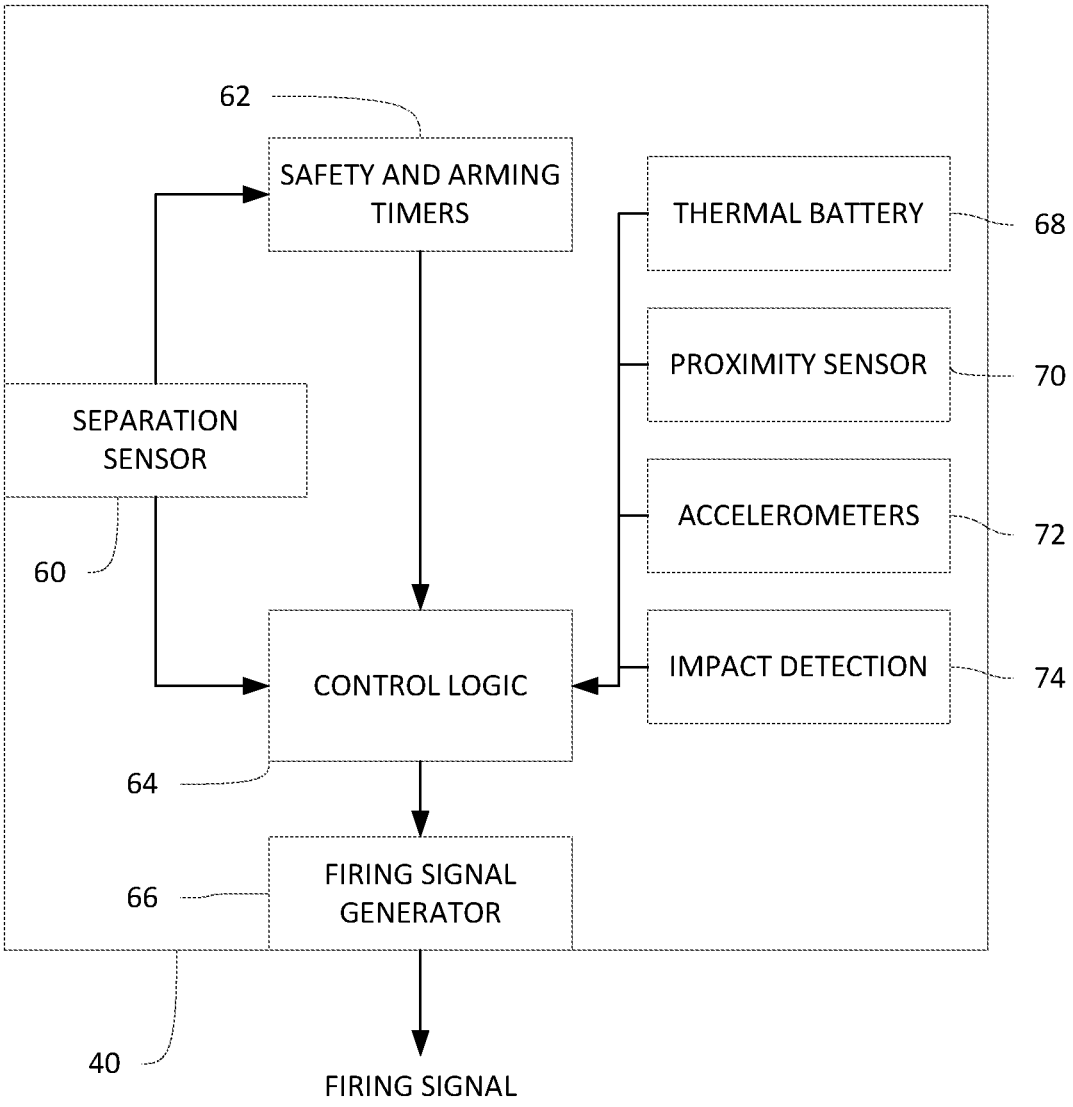
FIG. 3 shows a schematic diagram of a safety and arming device of the system illustrated in FIG. 1.
Figure 5:
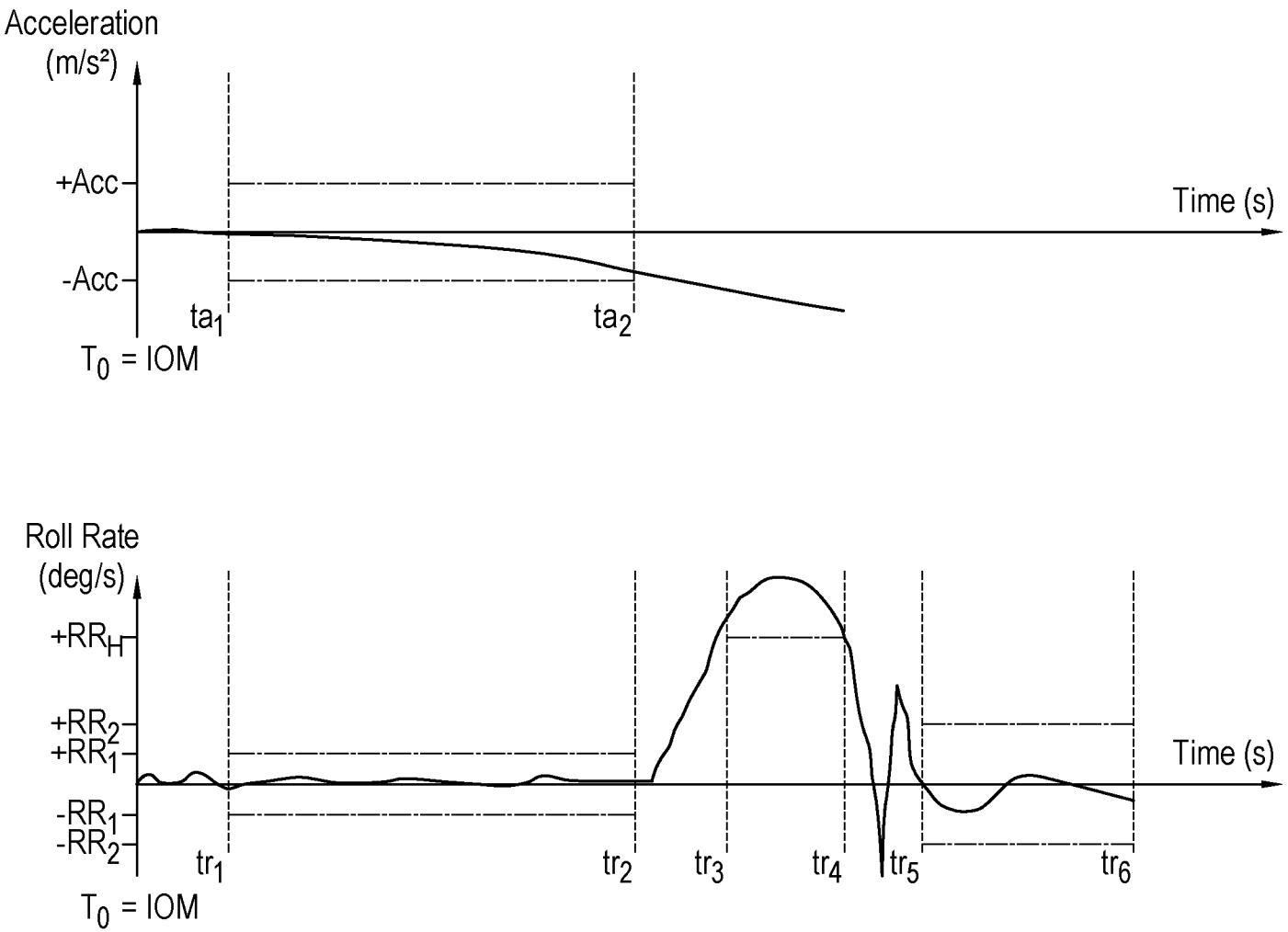
Figure 6:
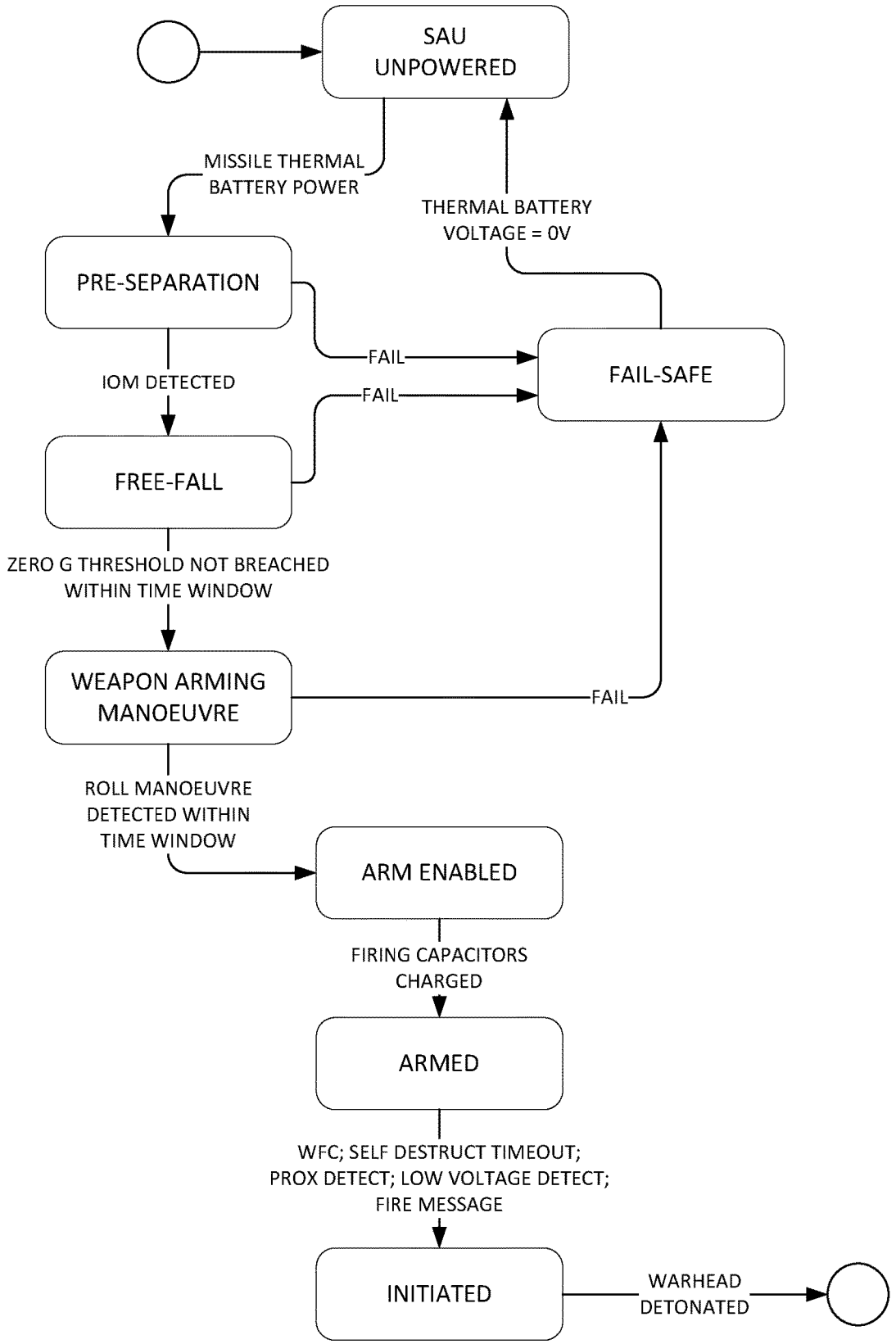

FIG. 5 comprises graphs illustrating threshold decisions to be taken by the safety and arming device in accordance with an embodiment; and FIG. 6 comprises a state transition diagram for control logic of the safety and arming device of FIG. 3.

DESCRIPTION OF EMBODIMENTS

In general terms, a safety and arming device for a munition is operable to arm and initiate a munition dependent on determining all of:

separation of the device from a munition platform, detection of free fall of the device through the duration of a first time period following separation, and following initiation of a roll manoeuvre of the munition, detection of the execution of the roll manoeuvre within a second time period.

An embodiment disclosed herein provides a safety and arming device for a munition, the device comprising a separation detector operable to generate a separation signal on detection of separation of the device from a delivery platform, a free fall detector operable to generate a free fall detection signal on detection of free fall of the device for a first time period following separation, a roll manoeuvre detector operable to generate a roll manoeuvre detection signal on detection of a roll manoeuvre of the device for a second time period, following the first time period, and a munition firing signal generator operable to generate a munition firing signal, wherein the munition firing signal generator is operable to generate the munition firing signal on presence of all of a separation signal, a free fall detection signal, and a roll manoeuvre detection signal.

Aspects of the described embodiments provide safety against the unintentional initiation of a munition warhead caused by transportation, storage, handling, aircraft carriage or inadvertent release.

In certain regulatory paradigms, two independent environments must be sensed by a safety and arming device, before the device can enter an armed state. In certain implementations, these environments should definitively distinguish an intentional and safe release. One implementation of relevance to the present disclosure is specified in STANAG 4187 and Mil-Std-1316. To ensure clarity, it is stated here that terms used in those standards should not necessarily influence the construction of terms in this disclosure, with particular, but not exclusive, reference to the term "safety and arming device".

Another requirement for certain implementations as disclosed herein is that a safety and arming device should ensure that the munition is a safe distance from the release platform before entering the armed state.

By way of background example, many existing second environment sensing based safety and arming devices employ sensing of airflow through a vane, parachute retardation or pressure sensing. These mechanisms may have disadvantages, in certain regards. For example, such criteria are not completely independent, they may directly impact munition performance, they may require special initiation arrangements on board a release platform before release, or they may require de-icing arrangements to be implemented.

Certain other background examples may provide sensing of free-fall and a pitch manoeuvre, to confirm the second arming environment. The pitch manoeuvre may impose a performance penalty on range and accuracy of the munition, when performed during terminal homing. It is difficult to define a pitch manoeuvre which cannot be generated falsely by all platforms prior to release or by ground handling.

Embodiments described herein may include, in general terms, sensing of a roll manoeuvre as a method of achieving second environment sensing. The execution of a roll manoeuvre does not affect range performance or terminal homing performance. Release platforms tend to be roll-rate limited and manual handling of munitions is extremely unlikely to result in roll of the munition through a complete rotation, so enabling clear discrimination between unintentional movements of the munition and an intentional roll manoeuvre.

Embodiments described herein provide a safety and arming device which is operable to sense free-fall during a defined time window after separation of the munition from its release platform, thus ensuring a sufficient separation distance from the release platform. Then, the munition independently executes a specific roll manoeuvre during a defined time window post-separation. The sensing of a defined roll manoeuvre during that defined time window confirms that the munition is not resting on the ground post-release, that it is not being manually handled, that it is not still on the release platform (in certain embodiments, the release platform will be an aircraft), and that it is under control.

While embodiments described herein employ the free-fall detection as an element of the arming process, recognition of the roll manoeuvre phase alone may be sufficient to enable distinction between accidental or unintentional movement of the munition and an intent to arm.

A specific embodiment will now be described with reference to the accompanying drawings.

Figure 1:
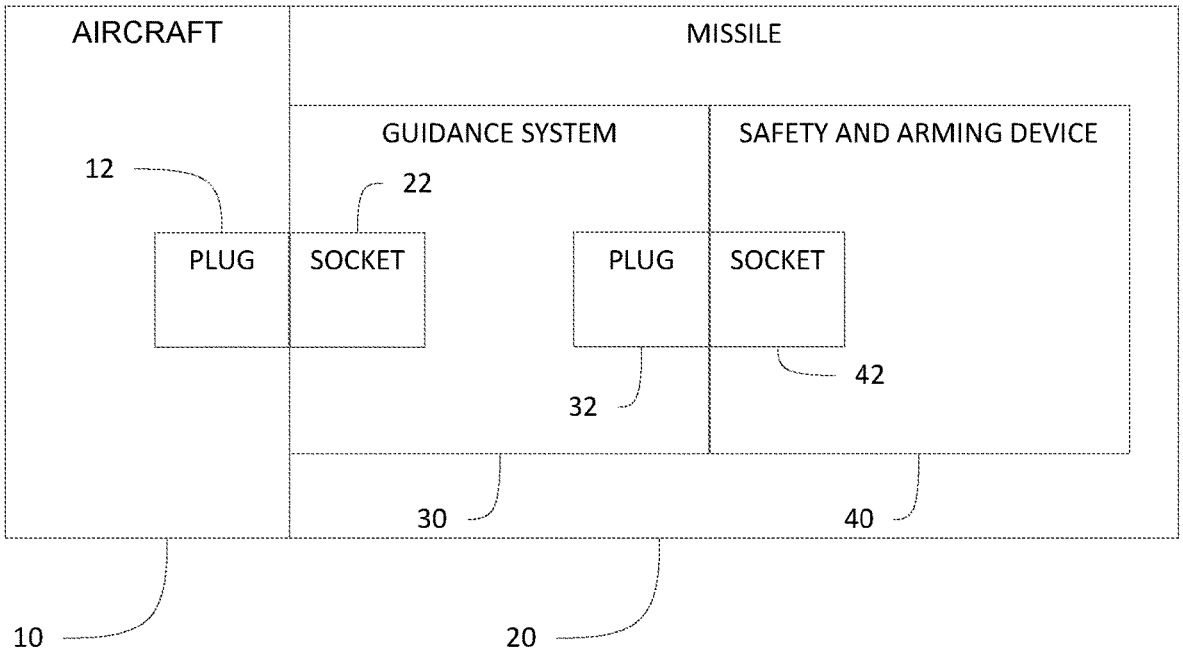
FIG. 1 shows a schematic general arrangement of a system comprising an aircraft providing a deployment platform for a missile munition, in accordance with an embodiment.

As noted above, FIG. 1 shows a schematic general arrangement of a system comprising an aircraft providing a deployment platform for a missile munition. The aircraft 10 and missile 20 are engaged with each other electrically by means of a plug 12 and socket 22 arrangement. This simply provides a ground line for the missile 20 with respect to the aircraft 10. When engaged, circuitry on the missile 20 will sense the existence of a ground line through to the aircraft 10, and when disengaged, the change in impedance from closed to open circuit will also be sensed as separation.

The missile comprises a guidance system 30 and a safety and arming device 40. These are engaged with each other by a plug 32 and socket 42 arrangement. The connection between the guidance system 30 and the safety and arming device provides the ground line, carried through from the aircraft, so that the separation sensing referred to above can be carried out at the safety and arming device 40.

The guidance system 30 and the safety and arming device 40 have integrated operation, to the extent that functions of the guidance system 30 are initiated on receipt of signals from the safety and arming device 40 indicative of an armed state. So, guidance of the missile 20 is triggered by the safety and arming device 40 indicating that conditions have been sensed that separation from the platform has been achieved successfully and that the intention to arm has been clearly detected.

Figure 2:
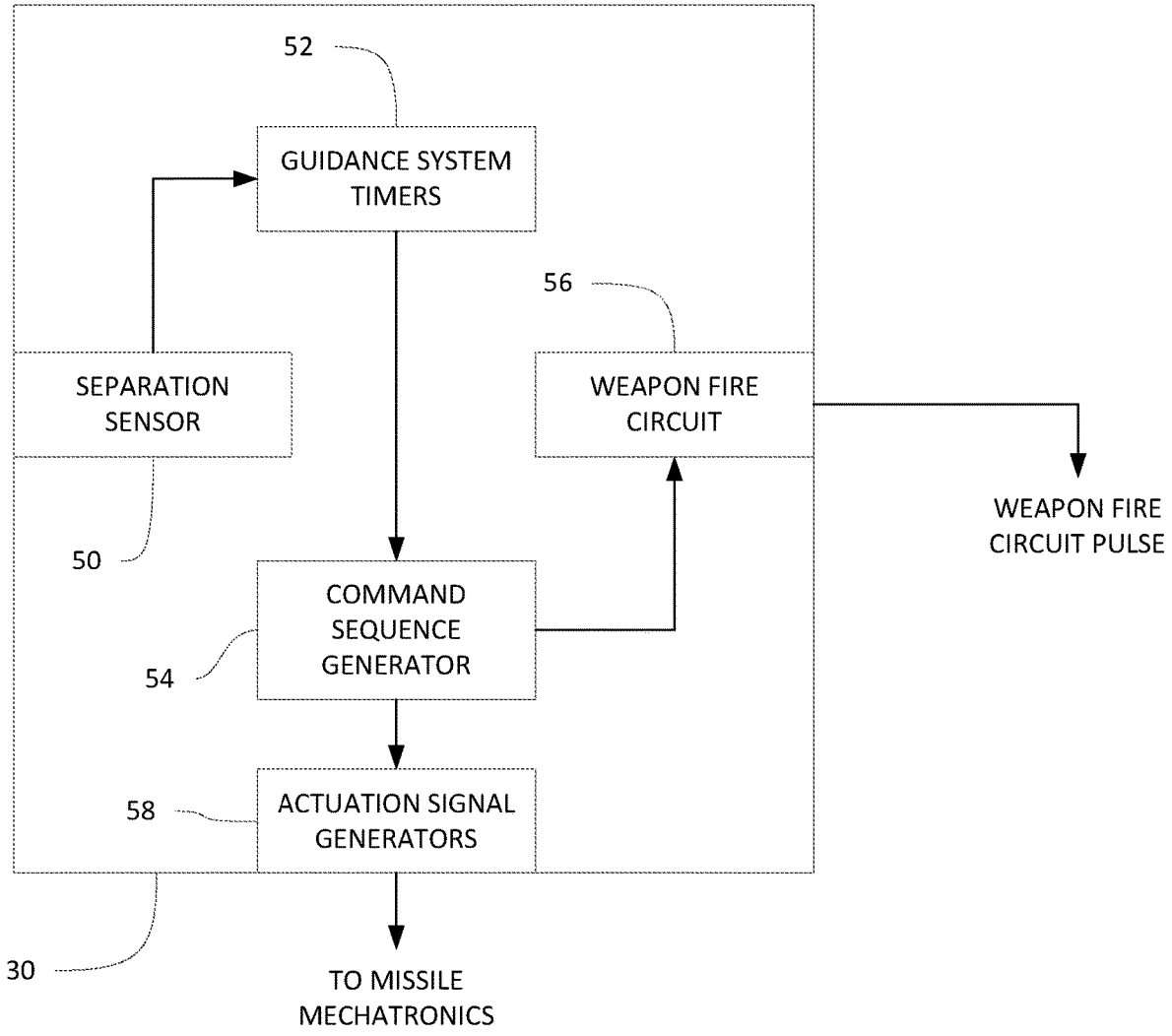
FIG. 2 shows a schematic diagram of a guidance system of the system illustrated in FIG. 1.

The elements of the guidance system 30 relevant to this disclosure are illustrated in FIG. 2.

The guidance system 30 comprises a separation sensor 50, which is triggered, as explained above, by disconnection of the plug 12 and socket 22 connecting the guidance system to the platform 10. This constitutes an "Instant of Move" (IOM) event, the significance of which will become clear from the further functional explanation below. A plurality of guidance system timers 52 are triggered by the IOM event. These provide timing windows of relevance to the operation of a command sequence generator 54, which is in operational control of the guidance of the missile 20. The command sequence generator 54 is operable to send actuation commands to actuation signal generators 58, which are in turn operable to emit driving signals to electromechanical components of the missile 20 employed in the guidance thereof.

The command sequence generator 54 is also operable to drive a weapon fire circuit 56 which, depending on the pre-configured command sequence, may emit a weapon fire circuit pulse intended to generate arming and detonation of the warhead munition.

The safety and arming device 40 is illustrated further in FIG. 3. It similarly comprises a separation sensor 60 which ensures establishment of the IOM event within the safety and arming device 40. This IOM event is used to trigger a plurality of safety and arming timers 62 configured to establish timing windows for operational use by control logic 64. Also input to the control logic 64 are a power supply from a thermal battery 68, a proximity signal from a proximity sensor 70, accelerometer signals from accelerometers 72 and an impact detection signal 74 from an impact detection facility 74.

The control logic 64 is configured to process inputs in accordance with functionality explained below, to cause a firing signal generator 66 to generate a firing signal which will cause detonation of the warhead.

The function of the control logic 64 will now be described with reference to FIGS. 4, 5 and 6.

Figure 4:
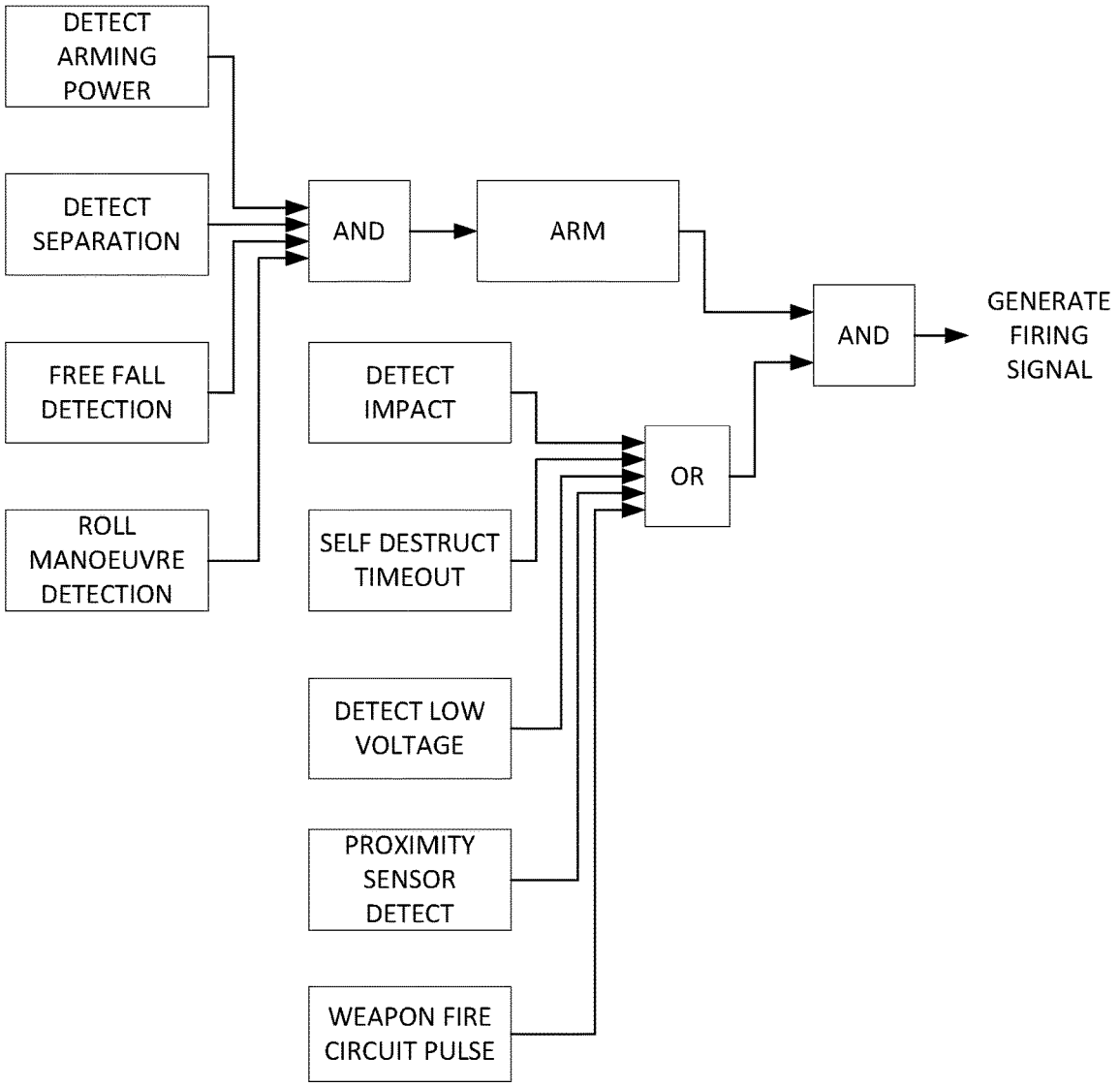
FIG. 4 is a process diagram illustrating process elements of the safety and arming device illustrated in FIG. 3.

As shown in FIG. 4, the process carried out by the control logic starts with four subprocesses. Firstly, arming power from the missile thermal battery is detected. Without this, the arming process cannot be carried out. Alongside this, separation is detected, and the IOM event is marked. This triggers commencement of two timing sequences.

A first timing sequence is associated with free fall detection. As shown in the upper plot of FIG. 5, acceleration of the missile in the x-axis (i.e. the longitudinal axis of the missile) in free fall is characterised by very gradual negative variation over time, within a threshold level. Thus, if acceleration is within the bounds of that threshold level for a determined time (here, measured between times ta1 and ta2 on the upper graph), then free fall is detected. Logic and/or executed program code can be implemented to achieve this.

A second timing sequence is associated with detecting a predetermined roll manoeuvre. This roll manoeuvre is carried out by the guidance system 30 on establishment of the IOM event. In essence, it comprises a full rotation around the longitudinal axis of the missile. As can be seen in the lower part of the graph in FIG. 5, the roll manoeuvre gives rise to three characteristic features in the plot of roll rate over time. First, there is a period, after the separation event, between times tr1 and tr2, when roll rate is low, and measured between two threshold bounds. Secondly, between times tr3 and tr4, the roll rate exceeds a particular threshold bound. After completion of the roll manoeuvre, the roll rate returns to a lower value in a further timing window between times tr5 and tr6.

Thus, the second timing sequence comprises three windows, within which measurements are made to determine satisfaction of the characteristic requirements for roll rate in the predetermined roll manoeuvre. If these requirements are met, then a roll manoeuvre is detected.

As shown in FIG. 4, all four of these conditions, namely the presence of arming power, the initiation of separation, free fall detection, and roll manoeuvre, are necessary to cause generation of an arming signal ("ARM" in FIG. 4) which causes charging of arming capacitors prior to triggering of detonation.

Alongside this, a trigger decision must be taken. This trigger decision can be made on the basis of one or more observations. As noted in FIG. 4, triggering can be as a result of impact detection, a self-destruct timeout, detection of low voltage, the detection by the proximity sensor that a target is within range, or an overriding weapon fire circuit pulse from the guidance system. On presence of any one of these, combined with successful arming of the munition detonation system, a firing signal is generated.

FIG. 6 recapitulates the above, in the form of a state transition diagram. From that diagram, it can be seen that there is a fail-safe mechanism which ensures that failure to detect free-fall or the required predetermined weapon arming roll manoeuvre, will result in no detonation. On the other hand, successful detection of these criteria will result in arming and detonation.

So, as illustrated, the initial condition of the control logic 64 is that the SAU is unpowered. In this state, the control logic is switched off and inactive.

On initiation of missile thermal battery power supply, the control logic 64 enters a pre-separation state. In this state, the control logic 64 seeks to detect an IOM event (as noted above). In the absence of an IOM event, a failure is logged and the control logic enters a fail-safe state.

On detection of an IOM event, the control logic 64 enters a free-fall state, in which a time window is established for determination as to whether the zero gravity threshold is breached—that is, whether the device really is in a free fall state. If this threshold is breached, then the control logic enters the aforementioned fail-safe state.

If the control logic enters the fail-safe state, it remains in this state until the thermal battery power supply is removed or is exhausted. In such circumstances, the control logic 64 can be considered to have returned to the initial unpowered condition.

On determination that the conditions for free fall have not been breached in the relevant time window, the control logic 64 enters a weapon arming manoeuvre state. In the weapon arming manoeuvre state, the control logic 64 drives the execution, by the missile, of a predetermined roll manoeuvre, and establishes a time window within which to detect execution of that roll manoeuvre with the use of suitable mechatronic sensors such as gyros.

If the roll manoeuvre is not detected within the time window, the control logic 64 enters the aforementioned fail-safe state. If the roll manoeuvre is detected within the time window, the control logic 64 transitions to an arm enabled state, in which the charging of firing capacitors is initiated.

Then, when the firing capacitors are charged, the control logic 64 enters an armed state, and awaits one of a selection of detonation initiation signals, including a weapon fire circuit (WFC) pulse, a self-destruct timeout signal, a proximity detection signal, a low voltage detection signal, or an overriding fire message such as from a remote controller. On receipt of such a signal, the control logic 64 enters an initiated state and the warhead is detonated by an ignition signal.

As will be understood, the exact implementation of the above will depend on a variety of factors, including available space and payload, power availability and other operational environmental constraints. A variety of analogue, digital, firmware and/or software implementations, including a combination of the same, are contemplated.

The parameters, such as by which power availability is assessed, or the time windows and various thresholds, or in fact the specific characteristic of the roll manoeuvre, can be tailored to the specific implementation.

While certain embodiments have been described, these embodiments have been presented by way of example only, and are not intended to limit the scope of the inventions. Indeed, the novel systems, devices and methods described herein may be embodied in a variety of other forms; furthermore, various omissions, substitutions and changes in the form of the systems, devices and methods described herein may be made without departing from the spirit of the inventions. The accompanying claims and their equivalents are intended to cover such forms or modifications as would fall within the scope and spirit of the inventions.

The invention claimed is:

1. A safety and arming device for a munition, the device comprising:

a separation detector operable to generate a separation signal on detection of separation of the device from a delivery platform;

a free fall detector operable to generate a free fall detection signal on detection of free fall of the device during a free fall phase following separation;

a roll manoeuvre detector operable to generate a roll manoeuvre detection signal on detection of a roll manoeuvre of the device, wherein the roll manoeuvre detector is configured to generate the roll manoeuvre detection signal if and only if:

during the free fall phase, a roll rate of the device is determined to be between a lower threshold and an upper threshold; and in a first time window after the free fall phase, the roll rate is determined to exceed a first roll-rate threshold that is above the upper threshold of the first time window; and in a second time window after the first time window, the roll rate is determined to be below a second roll-rate threshold, the second roll-rate threshold being lower than the first roll-rate threshold; and a munition firing signal generator operable to generate a munition firing signal, wherein the munition firing signal generator is operable to generate the munition firing signal only on presence of all of:

a separation signal, and a free fall detection signal, and a roll manoeuvre detection signal.

2. A safety and arming device in accordance with claim 1, wherein the separation detector comprises an electrical component capable of connection to a delivery platform, the separation detector being operable to detect an electrical characteristic of the electrical component, the electrical characteristic having a first condition when the electrical component is connected to a delivery platform and a second condition when the electrical component is not connected to a delivery platform, the separation detector being capable of distinguishing between the first and second conditions of the electrical characteristic.

3. A safety and arming device in accordance with claim 2 wherein the separation detector is operable to generate a separation signal on detection of change in the electrical characteristic from the first condition to the second condition.

4. A safety and arming device in accordance with claim 3 wherein the free fall detector comprises a free fall timer, operable to being initiated by a separation signal emitted in use by the separation detector, the free fall timer timing a free fall phase through which a munition, in use, is desired to free fall following separation from a delivery platform.

5. A safety and arming device in accordance with claim 4 wherein the free fall detector comprises an accelerometer operable to detect conditions of free fall.

6. A safety and arming device in accordance with claim 5 wherein the free fall detector is operable to output a free fall detection signal on determining that conditions of free fall are present throughout the free fall phase.

7. A safety and arming device in accordance with claim 6 wherein the free fall detector is operable to determine, from the accelerometer, the acceleration of the device, and to establish that, within the free fall phase, the magnitude of the acceleration remains below a predetermined threshold.

8. A safety and arming device in accordance with claim 4 wherein the roll manoeuvre detector comprises a roll manoeuvre timer, operable to initiate on completion of the free fall phase.

* * * * *